US007906911B2

(12) United States Patent
Wood et al.

(10) Patent No.: US 7,906,911 B2
(45) Date of Patent: Mar. 15, 2011

(54) LUMINAIRE ASSEMBLY HAVING A BONDED REFLECTOR CAVITY FOR SUPPORTING AN ULTRA-VIOLET LAMP

(75) Inventors: Charles H. Wood, Rockville, MD (US); Kevin Lascola, Columbia, MD (US); David A. Sprankle, Hagerstown, MD (US); George Jarrard, Westminster, MD (US)

(73) Assignee: Fusion UV Systems, Inc., Gaithersburg, MD (US)

( * ) Notice: Subject to any disclaimer, the term of this patent is extended or adjusted under 35 U.S.C. 154(b) by 336 days.

(21) Appl. No.: 12/149,447

(22) Filed: May 1, 2008

(65) Prior Publication Data

US 2009/0273932 A1 Nov. 5, 2009

(51) Int. Cl.
*H01J 65/04* (2006.01)

(52) U.S. Cl. ..... 315/39; 315/248

(58) Field of Classification Search ..... 315/39, 315/248

See application file for complete search history.

(56) References Cited

U.S. PATENT DOCUMENTS 4,933,602 A * 6/1990 Ono et al. ..... 315/39
5,008,593 A * 4/1991 Schlie et al. ..... 315/39
5,051,663 A * 9/1991 Ury et al. ..... 315/248
6,323,601 B1 * 11/2001 Klein et al. ..... 315/248

* cited by examiner

*Primary Examiner* — Benny Lee
(74) *Attorney, Agent, or Firm* — McDermott Will & Emery LLP

(57) ABSTRACT

A luminaire reflector comprises a first end reflector segment, a second end reflector segment, and a main reflector segment bonded together as a single-piece. The main reflector segment, the first end reflector segment, and the second end reflector segment form a microwave cavity that can accommodate a microwave-powered bulb. The luminaire reflector is configured to be mated to at least one waveguide of a luminaire assembly. The luminaire reflector comprises at least one RF coupling slot to transmit microwave energy from the waveguide side to the microwave cavity side of the reflector assembly.

12 Claims, 5 Drawing Sheets

LUMINAIRE ASSEMBLY HAVING A BONDED REFLECTOR CAVITY FOR SUPPORTING AN ULTRA-VIOLET LAMP

RELATED APPLICATION

This application is related to U.S. patent application Ser. No. 12/149,446, entitled "Radio Frequency Screen Assembly for Microwave Cavities," filed May 1, 2008, which is fully incorporated herein by reference.

DESCRIPTION OF THE INVENTION

1. Field of the Invention

An invention consistent with this disclosure relates to a bonded, single-piece lamp luminaire for microwave cavities, such as that used in connection with an electrode-less ultra-violet lamp.

2. Background of the Invention

Ultraviolet (UV) curing systems are in wide use. Among other uses, UV curing systems utilize UV radiation to cure adhesives and inks. UV curing presents a number of benefits over alternative curing methods. For example, UV curing may reduce costs, increase throughput, and provide a higher quality finished product.

Microwave-powered UV lamps, including luminaries, may be used to generate the required high energy UV radiation. Generally a curved or elliptical shaped reflector assembly is used in the luminaire to collect and focus the UV energy from the UV bulb into a highly concentrated area under the lamp system.

A prior art luminaire assembly 10 is shown in FIG. 1. The luminaire comprises one or more magnetrons and one or more waveguides encased in luminaire assembly housing 20. Luminaire assembly 10 further comprises luminaire reflector assembly 30. Luminaire reflector assembly 30 comprises main reflector 36 containing at least one microwave coupling slot 35 and two end reflectors 34 each with a bulb support hole 32. Luminaire reflector assembly 30 is configured to be mated to one or more waveguides encased in luminaire assembly 20 along with curved support ridges 29, and end reflector and gasket groove 27. RF screen assembly 40 is configured to be mated to reflector assembly 30. In luminaire assembly 10, RF screen assembly 40 and luminaire reflector assembly 30 are configured to form a microwave cavity that can accommodate microwave-powered bulb 50. Microwave-powered bulb 50 produces radiation which is collected by reflector assembly surfaces and exits the luminaire assembly through RF screen mesh material in the RF screen assembly 40. A luminaire assembly may include bulb centering spring plate 22. (Centering springs plate 22 allows a bulb to be inserted, or removed, into an installed reflector assembly. The centering spring plate 22 allows a microwave powered bulb 50 to be pushed through bulb support hole 32 far enough that the other end of the microwave powered bulb 50 can be inserted into the other bulb support hole 32. The centering spring plate 22 will center and stabilize the bulb in the two support holes.)

FIG. 2 shows a cross-section view of an alternative prior art luminaire assembly comprising luminaire housing assembly 20, and RF screen assembly 40. The luminaire assembly 10 of FIG. 2 also comprises magnetron 61 and waveguide 25. As shown in FIG. 2, a prior art luminaire assembly 10 may also contain a linear gasket rail 24 and a linear RF gasket 26. FIG. 2 also shows radiation 60 from microwave-powered bulb 50 emitting from a microwave cavity.

In the UV lamp depicted in FIG. 1, luminaire main reflector 36, end reflectors 34, and radio-frequency (RF) screen assembly 40 form the walls of a microwave cavity. The curved section of the main reflector 36 is fabricated from thin aluminum reflector sheet material. The curved section of the main reflector is flexible. To maintain the desired curved shape the main reflector 36 is supported by curved ridges 29. (In addition to supporting the main reflector, curved ridges 29 form the end of the waveguides. Curved ridges 29 further comprise a curved RF gasket.) In the prior art, the final curve shape of reflector is dependent upon installation technique. The end reflectors 34 are held in position in the luminaire by the fitting of RF gaskets in the waveguide end reflector and gasket groove 27 and by the installation of the curved main reflector 36. (End reflector and gasket groove 27 is configured to support the end reflector, and is further configured to support a gasket.) The precision of alignment of microwave-powered bulb 50 is determined by the end reflector position. In the prior art, the microwave-powered bulb position is not controlled to high precision relative to the curved reflector. In addition, in the prior art, one skilled in the art would understand that the end reflectors generally extend beyond the outer edge of the curved reflector. Thus, one skilled in the art would understand that the end reflectors have no influence on the precision of the curved reflector shape.

It is important that the microwave cavity exhibits a sufficiently tight seal. Luminaire reflector 36, end reflectors 34, and RF screen assembly 40 require direct electrical connection. A large enough potential microwave field difference between any of these components will result in dielectric breakdown arcing. Dielectric breakdown arcing can damage components. In addition, any gap between luminaire reflector assembly 30, RF screen assembly 40, or the gaskets of end reflector and gasket groove 27, or the gaskets of curved ridges 29, will allow microwave energy to escape the cavity. Escaping microwave energy can cause interference with other electronic equipment.

Among other maintenance, microwave-powered UV lamps will—from time to time—require new bulbs in the microwave cavity, new RF gaskets between the components of the cavity, or new luminaire reflector portions. As with any routine maintenance that requires disassembly of the luminaire, the time required to change bulbs, gaskets, or reflectors may be considerable due to the number of luminaire parts involved, and the requirement that the assembled system exhibit a tight microwave seal. Such maintenance may require significant and expensive downtime of production lines. Further, when such maintenance involves replacing or removing the end reflectors of the lamp luminaire, the requirement that a microwave-tight seal is maintained requires that replacement RF gaskets be fitted with each replaced end reflector. Of particular concern, and because replacing RF gaskets takes substantial time, users will sometimes skip the step of replacing the RF gaskets and leave old RF gaskets in place. Old RF gaskets may become hard and stiff with age. A new reflector may have a somewhat different shape than the old reflector. Old RF gaskets may no longer have the necessary flexibility to conform to the new reflector shape. Further, old RF gaskets may not be clean or properly fitted. Re-using old gaskets can cause arcing—or dielectric breakdown—to occur and components to be damaged.

Consequently, it is desirable to reduce maintenance requirements in the field. It is accordingly an object of the invention to make it easier and/or faster to maintain UV lamps in the field. It is one object of the invention to make the RF gasket seal less prone to arcing and therefore more reliable. It is one object of the invention to make the shape of the ellipse more precise. It is yet another object of the invention to better control the location of the bulb at the preferred position within the ellipse. The present invention solves the aforementioned problems.

SUMMARY OF THE INVENTION

An invention consistent with the present disclosure relates to a bonded, single-piece lamp luminaire for a microwave cavity in UV lamps. The present invention provides for a luminaire reflector assembly comprising a main reflector segment bonded to two or more end reflector segments. In accordance with the present invention, the luminaire reflector assembly is improved in mechanical stability, shape precision, optical focusing performance and RF electrical contact over the prior art. The main reflector segment and the end reflector segments are mated in a manner improved over the prior art. The main reflector segment and the end reflector segments are bonded through a means that eliminates the need for an RF gasket to maintain electrical connection between the main reflector segment and the end reflector segments.

The present invention also provides for the luminaire reflector assembly as discussed above where the main reflector segment is bonded to the end reflector segments with metal foil tape.

The present invention also provides for the luminaire reflector assembly as discussed above where the main reflector segment is bonded to the end reflector segments by crimping.

The present invention also provides for the luminaire reflector assembly as discussed above where the main reflector segment is bonded to the end reflector segments through welding. The invention provides for the welding done by electric arc welding, laser welding, or other types of welding.

The present invention also provides for a luminaire assembly comprising a luminaire reflector assembly of any of the previous embodiments. The luminaire assembly further comprises at least one magnetron, a radio-frequency screen assembly, and a microwave-powered bulb. The microwave-powered bulb is supported by a first end reflector segment of the luminaire reflector assembly and a second end reflector segment of the luminaire reflector assembly. The luminaire assembly further comprises at least one waveguide which is configured to couple energy from the at least one magnetron to the microwave-powered bulb.

Additional objects and advantages of the invention will be set forth in part in the description which follows, and in part will be obvious from the description, or may be learned by practice of the invention. The objects and advantages of the invention will be realized and attained by means of the elements and combinations particularly pointed out in the appended claims.

It is to be understood that both the foregoing general description and the following detailed description are exemplary and explanatory only and are not restrictive of the invention, as claimed.

The accompanying drawings, which are incorporated in and constitute a part of this specification, illustrate several embodiments of the invention and, together with the description, serve to explain the principles of the invention.

DETAILED DESCRIPTION OF THE EMBODIMENTS

Reference will now be made in detail to the present embodiments (exemplary embodiments) of the invention, examples of which are illustrated in the accompanying drawings. Wherever possible, the same reference numbers will be used throughout the drawings to refer to the same or like parts and may not be described in detail throughout the drawings.

Figure 3:
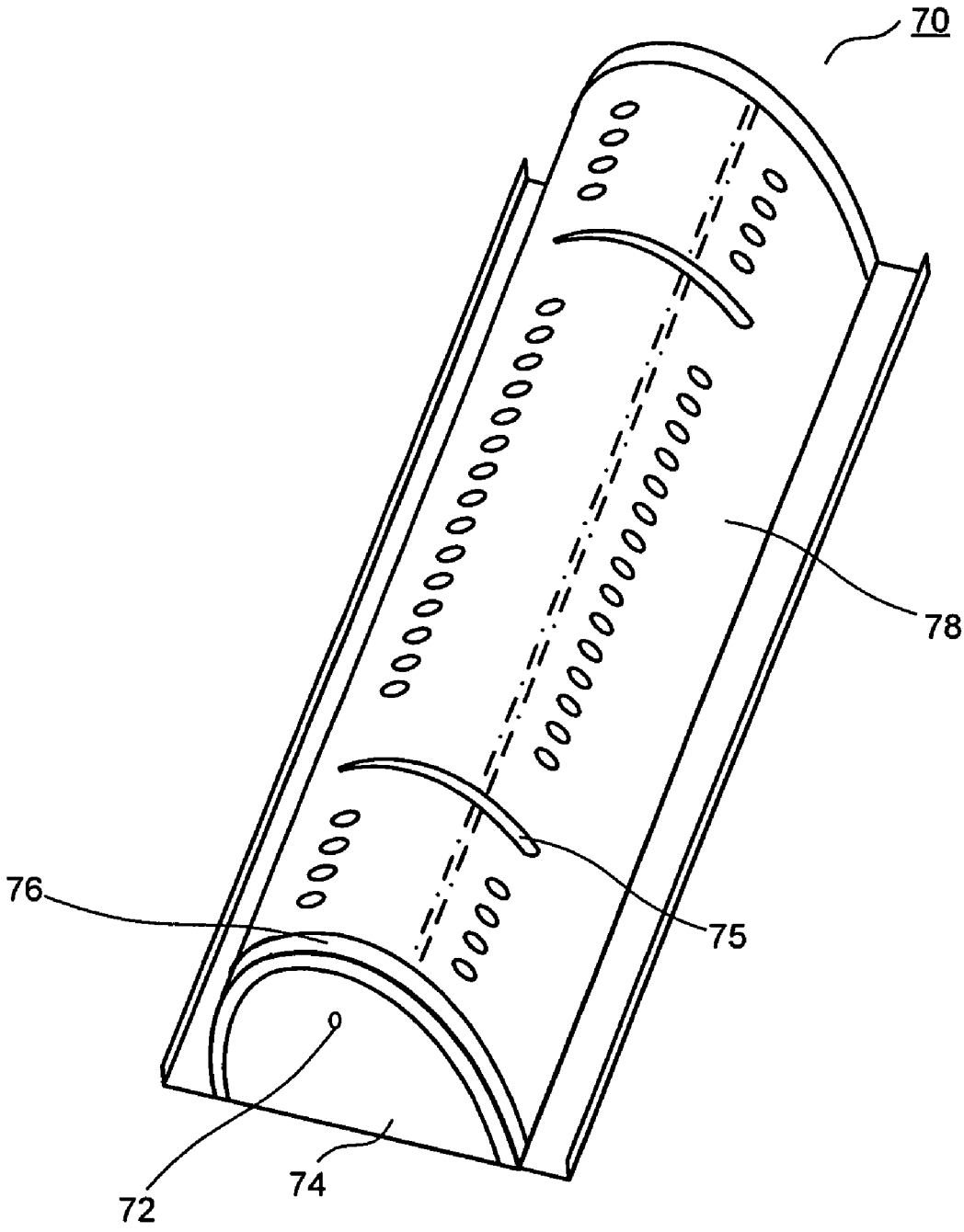
FIG. 3 is a view of a luminaire reflector assembly consistent with an embodiment of the present invention.

A luminaire reflector assembly consistent with an embodiment of the present invention is shown in FIG. 3. Luminaire reflector assembly 70 comprises main reflector segment 78, first end reflector segment 74, first end reflector bulb support hole 72, and reflector bond 76. Luminaire reflector assembly 70 further comprises a second end reflector segment, substantially similar to first end reflector segment 74, and a second end reflector bulb support hole, substantially similar to first end reflector bulb support hole 72.

First end reflector segment 74 has a first edge that follows a substantially linear path (such as that which is proximal to RF screen assembly 40, when assembled (see FIG. 4)), and a second edge that follows a substantially curved path (such as that proximal to reflector bond 76). The substantially linear path of the first edge of first end reflector segment 74 and the substantially curved path of the second edge of first end reflector segment 74 intersect and form an enclosed region bounded by the first edge and the second edge of first end reflector segment 74. In one embodiment, the second edge of the first end reflector segment comprises a segment of a second order curve. In another embodiment, the second edge of the first end reflector segment comprises a plurality of segments of second order curves. In another embodiment, the second edge of the first end reflector segment is a parabola. In another embodiment, the second edge of the first end reflector segment comprises a portion of an ellipse.

An embodiment consistent with the present invention utilizes end reflectors specially formed with a specific shape. The end reflectors are preferably constructed with an edge matching the desired curved shape for the inside of the reflector assembly. Consistent with the present invention the end reflectors are preferably positioned inside the main reflector, forcing the main reflector into the same shape. The main reflector segment and end reflector segments are then preferably bonded to retain the main reflector in the desired shape.

Figure 4:
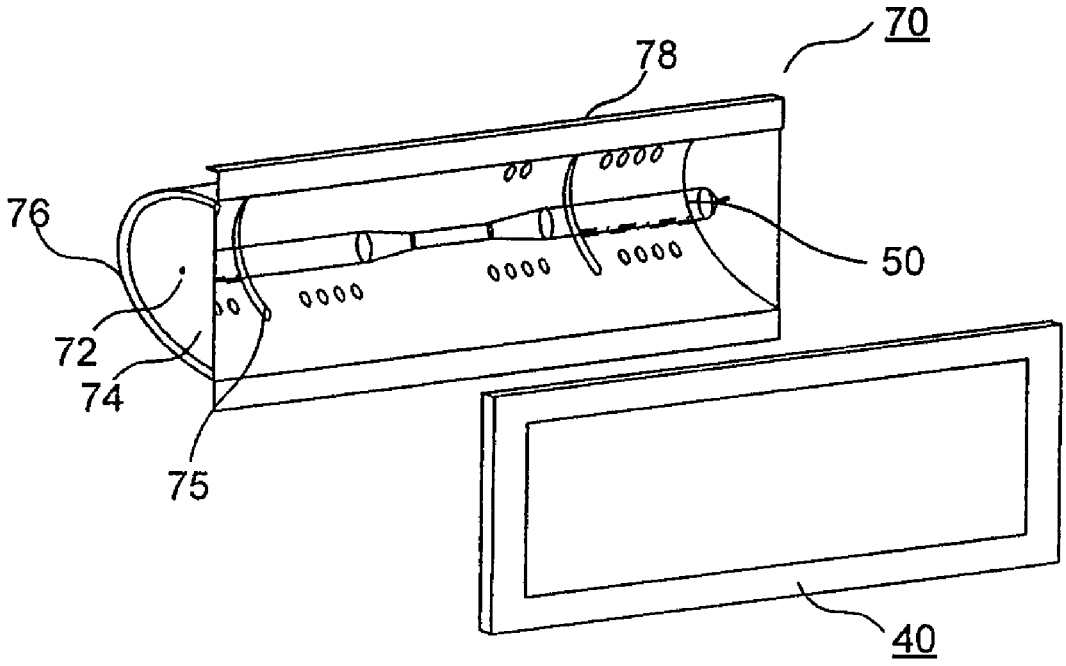
FIG. 4 is view of a luminaire reflector assembly and an RF screen assembly consistent with an embodiment of the present invention.

A main reflector segment and a first end reflector segment are preferably configured to be bonded. FIGS. 3 and 4 depict exemplary reflector bond 76. In one embodiment, main reflector segment 78 and first end reflector segment 74 are bonded together such that reflector bond 76 comprises metal foil tape. In another embodiment, main reflector segment 78 and first end reflector segment 74 are bonded by crimping such that reflector bond 76 comprises crimped edges. In another embodiment, main reflector segment 78 and first end reflector segment 74 are bonded together such that reflector bond 76 comprises welded components. In yet another embodiment, the welded components are bond by electric arc welding. In still another embodiment, the welded components are bonded by laser welding. The bonded reflector assembly has advantages over the prior art. The bonded assembly shape may be more rigid and may be maintained with better mechanical precision. Further, the bonded assembly ensures that the bulb is fixed with reference to the reflector. In this regard, for example, the bonded assembly may provide for better optical performance over the prior art.

Figure 1:
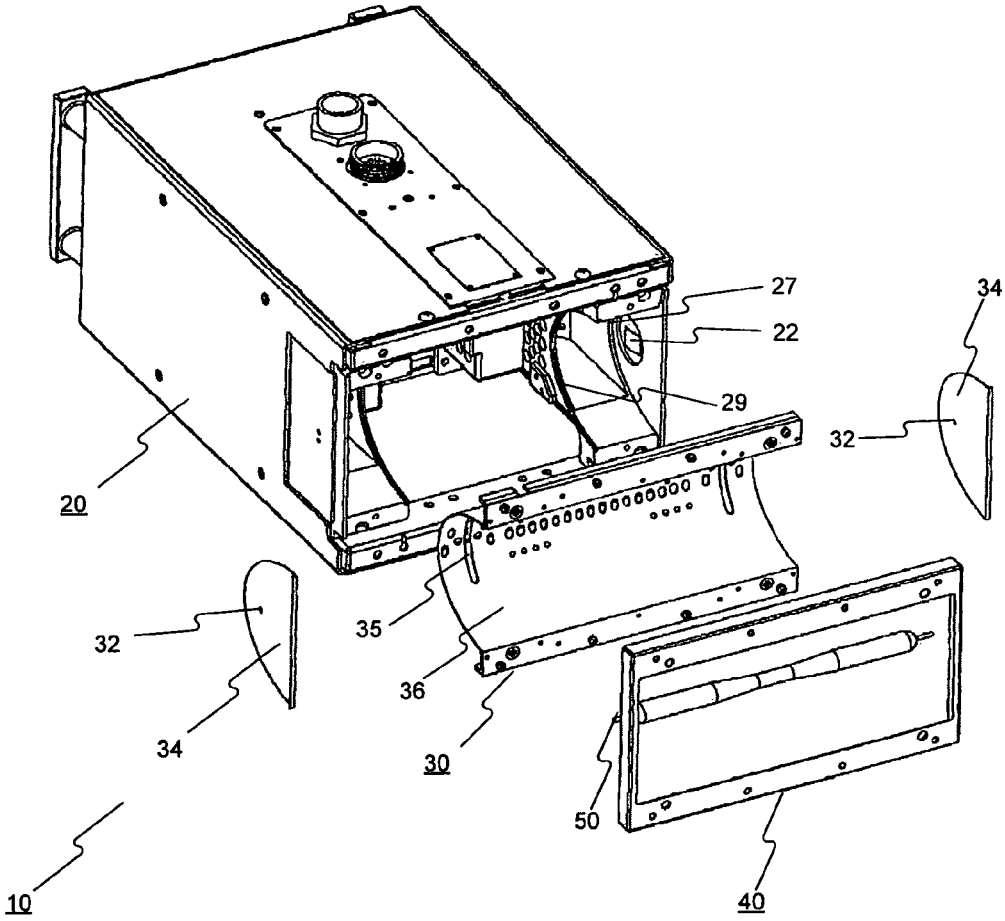
FIG. 1 (PRIOR ART)
FIG. 1 is a view of a deconstructed prior art luminaire assembly.
Figure 2:
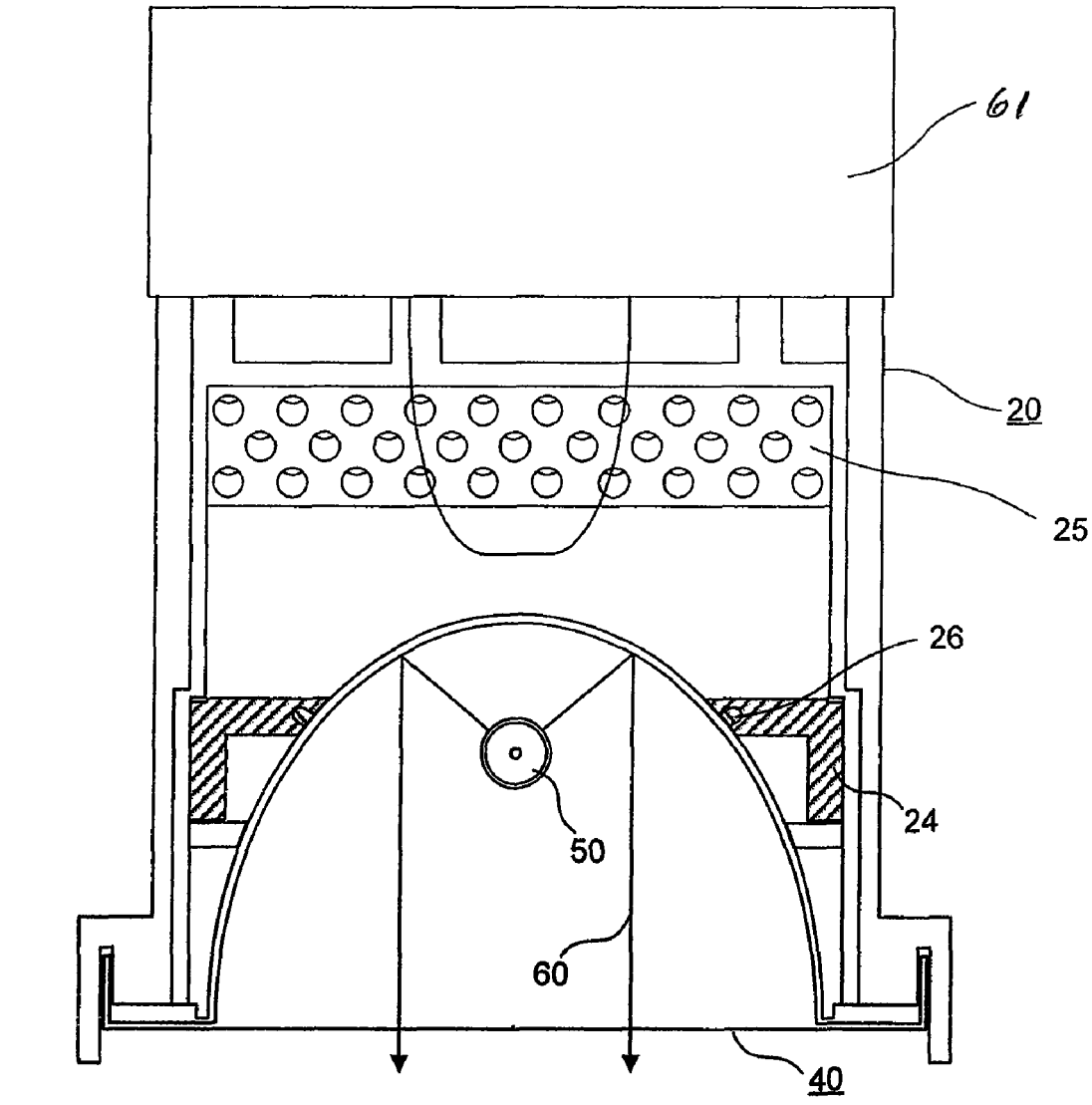
FIG. 2 (PRIOR ART)
FIG. 2 is a cross-section view of an alternative prior art luminaire assembly.

A luminaire reflector assembly and an RF screen assembly consistent with an embodiment of the present invention is shown in FIG. 4. The luminaire reflector assembly and an RF screen assembly of FIG. 4 are configured to be mated with a luminaire assembly. The luminaire assembly comprises a luminaire assembly housing substantially similar to 20 of FIG. 1. The luminaire assembly housing contains one or more waveguides, end reflector grooves, and curved support ridges. The luminaire assembly further comprises luminaire reflector assembly 70, microwave-powered bulb 50, and radio-frequency (RF) screen assembly 40. Luminaire reflector assembly 70 comprises main reflector segment 78 with microwave coupling slot 75 (also shown in FIG. 3), first and second end reflector segment 74, first and second end reflector bulb support hole 72, and reflector bond 76. The luminaire assembly may further comprise housing bulb centering spring plates. The luminaire assembly may further comprise a linear gasket rail and an RF gasket.

As described above, in one embodiment, main reflector segment 78 and first and second end reflector segment 74 are bonded together such that reflector bond 76 comprises metal foil tape. In another embodiment, main reflector segment 78 and first and second end reflector segment 74 are bonded by crimping such that reflector bond 76 comprises crimped edges. In another embodiment, main reflector segment 78 and first and second end reflector segment 74 are bonded together such that reflector bond 76 comprises welded components. In yet another embodiment, the welded components are bonded by electric arc welding. In still another embodiment, the welded components are bonded by laser welding. In an embodiment the laser welding is computer automated laser welding.

Figure 5:
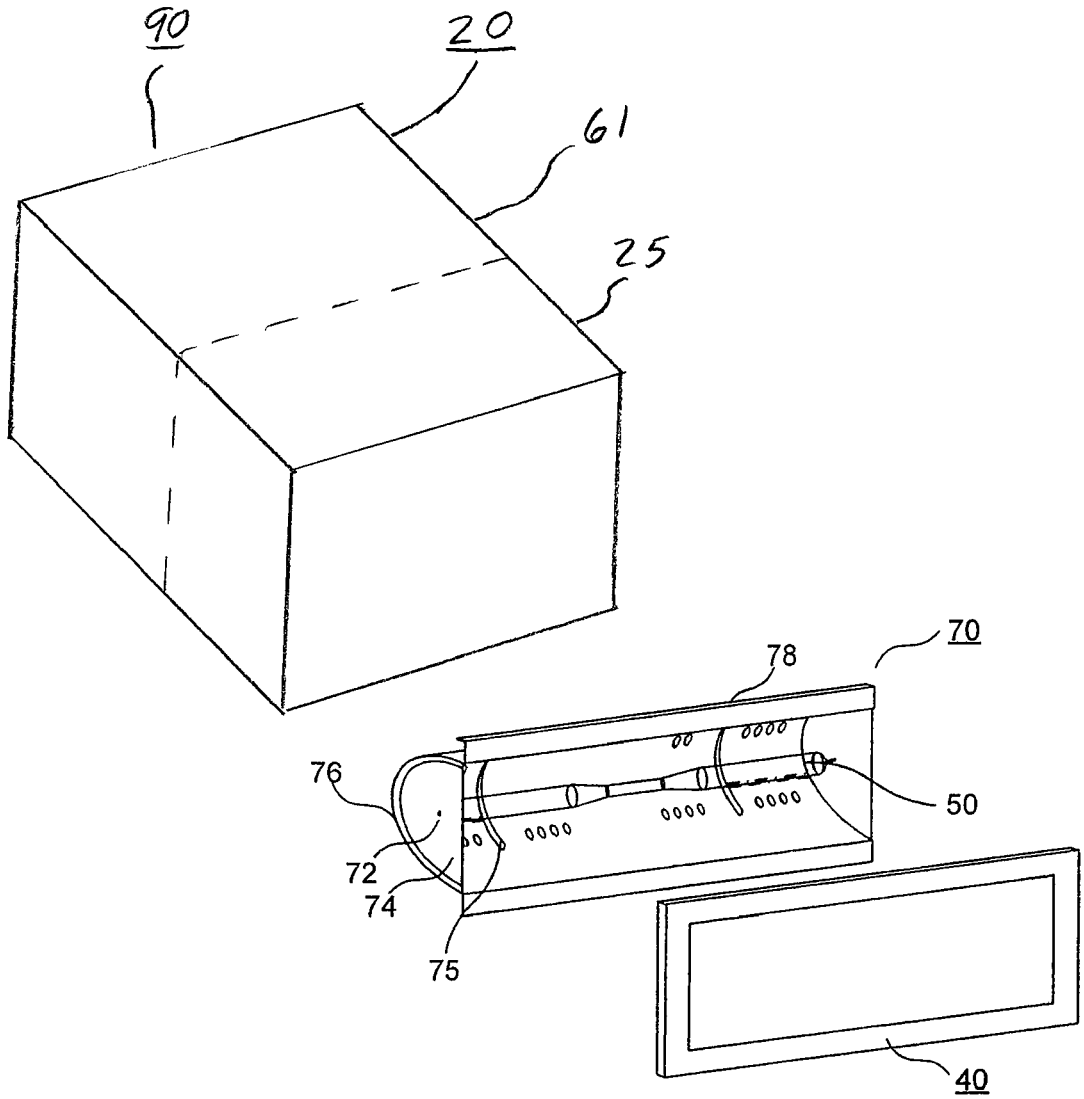
FIG. 5 is a view of a luminaire assembly according to an embodiment of the present invention.

In one embodiment of the present disclosure, a luminaire assembly 90 comprises a luminaire reflector assembly 70, at least one magnetron 61, a radio-frequency screen assembly 40, and a microwave-powered bulb 50, as shown in FIG. 5. The microwave-powered bulb 50 is supported by the first end reflector segment 74 and the second end reflector segment 74. The at least one waveguide 25 is configured to couple energy from the at least one magnetron 61 of the luminaire assembly 90 to the microwave-powered bulb 50 in a manner as similarly depicted in prior art FIG. 1.

Other embodiments of the invention will be apparent to those skilled in the art from consideration of the specification and practice of the invention disclosed herein. For example, additional components can be incorporated into a single assembly. By way of example only, in one embodiment, and in addition to a main reflector bonded to a first end reflector segment, a microwave-powered bulb can be affixed into the assembly. In another embodiment, in addition to a main reflector bonded to a first end reflector segment, an RF screen can be affixed to the main reflector. It is intended that the specification and examples be considered as exemplary only, with a true scope and spirit of the invention being indicated by the following claims.

What is claimed is:

1. A luminaire reflector comprising:

a first end reflector segment;

a second end reflector segment; and a main reflector segment;

wherein the first end reflector segment has a first edge that follows a substantially linear path and a second edge that follows a substantially curved path;

wherein the substantially linear path of the first edge of the first end reflector segment and the substantially curved path of the second edge of the first end reflector segment intersect and form a first enclosed region bounded by the first edge and the second edge of the first end reflector segment;

wherein the second end reflector segment has a first edge that follows a substantially linear path and a second edge that follows a substantially curved path;

wherein the substantially linear path of the first edge of the second end reflector segment and the substantially curved path of the second edge of the second end reflector segment intersect and form a second enclosed region bounded by the first edge and the second edge of the second end reflector segment;

wherein the first enclosed region is substantially similar to the second enclosed region;

wherein the main reflector segment has at least a first edge and a second edge;

wherein the first edge of the main reflector segment is bonded to the second edge of the first end reflector segment by metal foil tape, crimping, or welding, and the second edge of the main reflector segment is bonded to the second edge of the second end reflector segment;

wherein the main reflector segment, the first end reflector segment, and the second end reflector segment form a microwave cavity that can accommodate a microwave-powered bulb;

wherein the first end reflector segment and the second end reflector segment are configured to support the microwave-powered bulb that can be accommodated within the microwave cavity;

wherein the luminaire reflector comprises at least one microwave coupling slot in the main reflector designed to transmit microwave energy from a waveguide side to a microwave cavity side of the reflector assembly; and wherein the luminaire reflector is configured to be mated to at least one waveguide of a luminaire assembly.

2. The luminaire reflector of claim 1, wherein the substantially curved path of the second edge of the first end reflector segment comprises a segment of a second order curve.

3. The luminaire reflector of claim 1, wherein the welding is electric arc welding.

4. The luminaire reflector of claim 2, wherein the second order curve is a parabola.

5. The luminaire reflector of claim 2, wherein the second order curve is a portion of an ellipse.

6. The luminaire reflector of claim 1, wherein the welding is electric laser welding.

7. A luminaire assembly comprising:

the luminaire reflector of claim 1;

at least one magnetron; and a radio-frequency screen assembly;

wherein the at least one waveguide is configured to couple energy from the at least one magnetron of the luminaire assembly to the microwave-powered bulb.

8. The luminaire assembly of claim 7, wherein the welding is electric laser welding.

9. The luminaire assembly of claim 7,
wherein the welding is electric arc welding.

10. The luminaire assembly of claim 7,
wherein the substantially curved path of the second edge of the first end reflector segment comprises a segment of a second order curve.

11. The luminaire assembly of claim 10,
wherein the second order curve is a parabola.

12. The luminaire assembly of claim 10,
wherein the second order curve is a portion of an ellipse.

* * * * *